US007543909B2

(12) United States Patent
Shimizu

(10) Patent No.: US 7,543,909 B2
(45) Date of Patent: Jun. 9, 2009

(54) WIPER DEVICE AND LIQUID EJECTION APPARATUS

(75) Inventor: Yoshiaki Shimizu, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 457 days.

(21) Appl. No.: 11/411,053

(22) Filed: Apr. 26, 2006

(65) Prior Publication Data

US 2006/0250441 A1 Nov. 9, 2006

(30) Foreign Application Priority Data

Apr. 26, 2005 (JP) ..... 2005-128534

(51) Int. Cl.
*B41J 2/165* (2006.01)

(52) U.S. Cl. ..... 347/33; 347/23; 347/32

(58) Field of Classification Search ..... 347/33, 347/29, 30, 32, 23
See application file for complete search history.

(56) References Cited

U.S. PATENT DOCUMENTS 5,486,850 A 1/1996 Nakamura
6,033,052 A 3/2000 Muraki
6,155,667 A * 12/2000 Eckard et al. ..... 347/33
6,318,835 B2 * 11/2001 Nakahara ..... 347/30
2002/0122092 A1 9/2002 Okamura et al.
2004/0257396 A1 12/2004 Nishida et al.

FOREIGN PATENT DOCUMENTS

EP 1 488 929 A1 12/2004
JP 2000-198211 A 7/2000
JP 2001-001533 A 1/2001

* cited by examiner

*Primary Examiner*—Shih-wen Hsieh
(74) *Attorney, Agent, or Firm*—Sughrue Mion, PLLC

(57) ABSTRACT

A wiper device of a liquid ejection apparatus includes a first wiper that wipes a nozzle surface defined in a liquid ejection head, a second wiper that wipes a side surface of the liquid ejection head extending in a direction intersecting the nozzle surface, and a drive mechanism that drives the first and second wipers to move between respective standby positions and wiping positions. The second wiper is formed separately from a cap that seals the nozzle surface of the liquid ejection head. The drive mechanism operates to move the second wiper to the corresponding wiping position independently from the first wiper. In this manner, independent wiping of the side surface of the liquid ejection head is performed when desired.

6 Claims, 4 Drawing Sheets

WIPER DEVICE AND LIQUID EJECTION APPARATUS

CROSS-REFERENCE TO RELATED APPLICATIONS

This application is based upon and claims the benefit of priority from prior Japanese Patent Application No. 2005-128534, filed on Apr. 26, 2005, the entire contents of which are incorporated herein by reference.

BACKGROUND

The present invention relates to wiper devices and liquid ejection apparatuses.

Inkjet type printers are widely known as liquid ejection apparatuses that eject liquid onto a target from a recording head, or a liquid ejection head, which includes a plurality of nozzles. Specifically, the printer ejects ink from the recording head as the liquid. After having been ejected, the ink may adhere to a portion in the vicinity of a nozzle opening or be splashed by a recording medium, such as a sheet of paper, thus adhering to a nozzle surface or a side surface of the recording head. If the recording head is contaminated by the ink, offset ejection of ink droplets or clogging of the nozzles may occur, leading to printing problems. In order to solve these problems, the printer is normally provided with a wiper device that cleans the nozzle surface and the side surface of the recording head.

For example, a wiper device described in Japanese Laid-Open Patent publication No. 2000-198211 includes a wiper formed of rubber. The wiper is held by a cap holder in such a manner that the wiper is selectively raised and lowered. A slit is defined in the wiper at a position corresponding to a side surface of a recording head. In operation, the wiper slides along the recording head while overlapping the recording head in a vertical direction by an amount of approximately 1 mm. This causes the top surface of the wiper to wipe a nozzle surface defined in the recording head and the slit to wipe off the ink from the side surface of the recording head.

However, in this wiper device, a nozzle surface wiper (the top surface of the wiper), which wipes the nozzle surface of the recording head, and a side surface wiper (the slit of the wiper), which wipes the side surface of the recording head, are formed as an integral body. It is thus impossible to wipe the side surface of the recording head without involving the nozzle surface. In other words, wiping of the side surface and wiping of the nozzle surface of the recording head must be performed always in combination. If the nozzle surface is wiped (wiped dry) when the nozzle surface is free from excessive ink, meniscus of ink in nozzle openings is damaged, thus causing a printing problem. Also, wiping of the side surface of the recording head can be brought about only when cleaning of the nozzle surface is performed. Thus, even when wiping of only the side surface of the recording head is desirable, such operation is not allowed.

In another wiper device described in Japanese Laid-Open Patent Publication No. 2000-198211, a side surface wiper is formed integrally with a cap, which seals a nozzle surface when cleaning a recording head, and independently from a nozzle surface wiper. Exclusive wiping of the side surface of the recording head thus can be performed independently from wiping of the nozzle surface. However, wiping of the side surface of the recording head cannot be performed unless the cap is in capping operation. In other words, the capping operation necessarily causes the wiping of the side surface of the recording head. This increases the frequency of such wiping, thus decreasing the durability of the wiper.

SUMMARY

An advantage of some aspects of the present invention is to provide a wiper device capable of wiping a side surface of a liquid ejection head independently when desirable, and a liquid ejection apparatus including such a wiper device.

To achieve the foregoing and other objectives and in accordance with the purpose of the present invention, an aspect of the invention provides a wiper device including a first wiper, a second wiper and a drive mechanism. The first wiper wipes a nozzle surface defined in a liquid ejection head. The second wiper wipes a side surface of the liquid ejection head extending in a direction intersecting the nozzle surface. The second wiper is formed separately from a cap that seals the nozzle surface of the liquid ejection head. The drive mechanism drives the first and second wipers to move between respective standby positions and wiping positions. The drive mechanism operates to move the second wiper to the corresponding wiping position independently from the first wiper.

Another aspect of the invention provides a liquid ejection apparatus including a liquid ejection head, a cap and a wiper device. The liquid ejection head has a nozzle surface and a side surface extending in a direction intersecting the nozzle surface. The cap seals the nozzle surface of the liquid ejection head. The wiper device includes a first wiper, a second wiper and a drive mechanism. The first wiper wipes a nozzle surface defined in a liquid ejection head. The second wiper wipes a side surface of the liquid ejection head extending in a direction intersecting the nozzle surface. The second wiper is formed separately from a cap that seals the nozzle surface of the liquid ejection head. The drive mechanism drives the first and second wipers to move between respective standby positions and wiping positions. The drive mechanism operates to move the second wiper to the corresponding wiping position independently from the first wiper.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

An embodiment of the present invention will now be described with reference to FIGS. 1 to 6.

Figure 1:
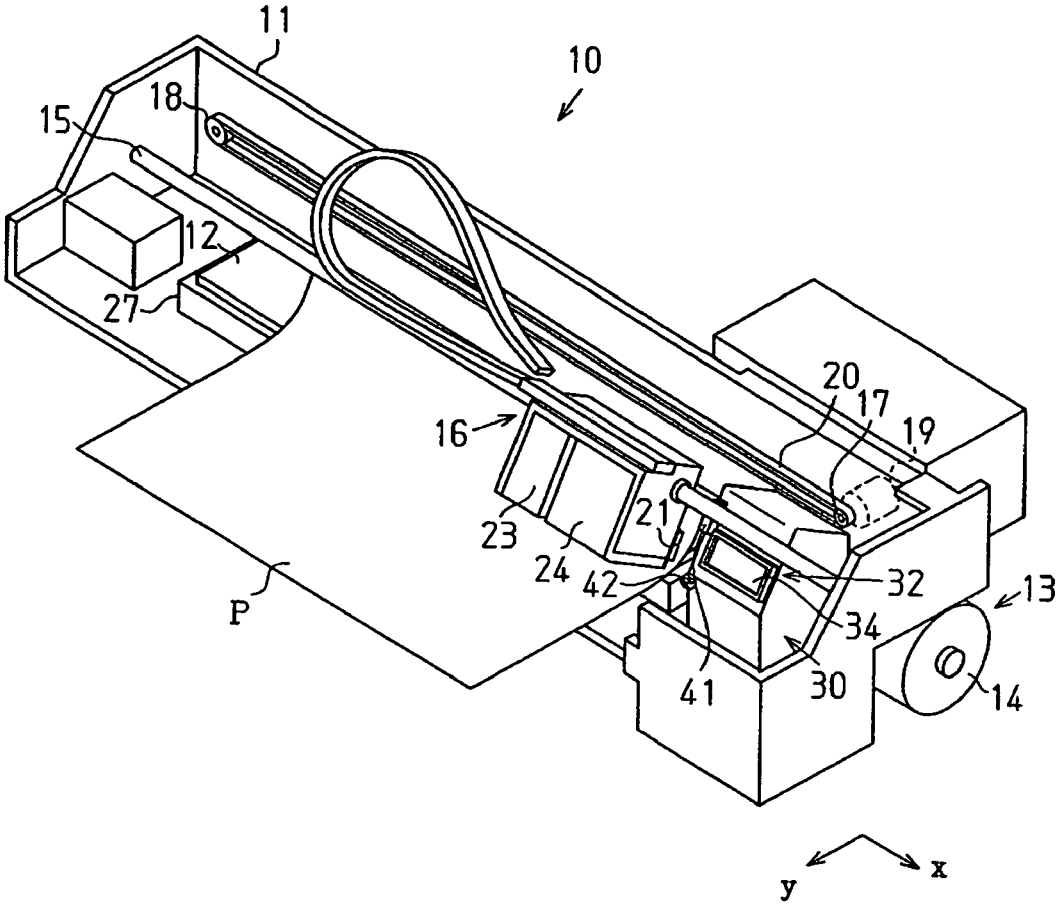
FIG. 1 is a perspective view showing a printer according to an embodiment of the present invention.

As shown in FIG. 1, an on-carriage type printer 10, or a liquid ejection apparatus of the illustrated embodiment, includes a substantially box-like frame 11. A platen 12 is provided in a lower part of the space defined by the frame 11, extending in a longitudinal direction of the frame 11 (a main scanning direction x of FIG. 1). The platen 12 functions as a support table that supports a sheet of paper P, or a target, and is driven by a paper feeder motor 14, which is provided in a paper feeder mechanism 13. The platen 12 thus sends the paper sheet P in a sub scanning direction y perpendicular to the main scanning direction x. In the following description, the feeding direction of the paper sheet P is defined as a forward direction and opposing sides with respect to this direction are defined as left and right sides, as viewed from in front of the printer 10.

A guide shaft 15 is arranged in the frame 11 and extends above the platen 12. The guide shaft 15 is passed through a carriage 16 that is held in an inclined state. A drive pulley 17 and a driven pulley 18 are rotatably provided on an inner surface of the frame 11 at positions corresponding to opposing ends of the guide shaft 15. A carriage motor 19 is connected to the drive pulley 17. A timing belt 20 is wound around the pulleys 17, 18. The carriage 16 is securely supported by the timing belt 20. The carriage 16 is thus moved in the main scanning direction x through the timing belt 20 while driven by the carriage motor 19 and guided by the guide shaft 15.

Figure 2:
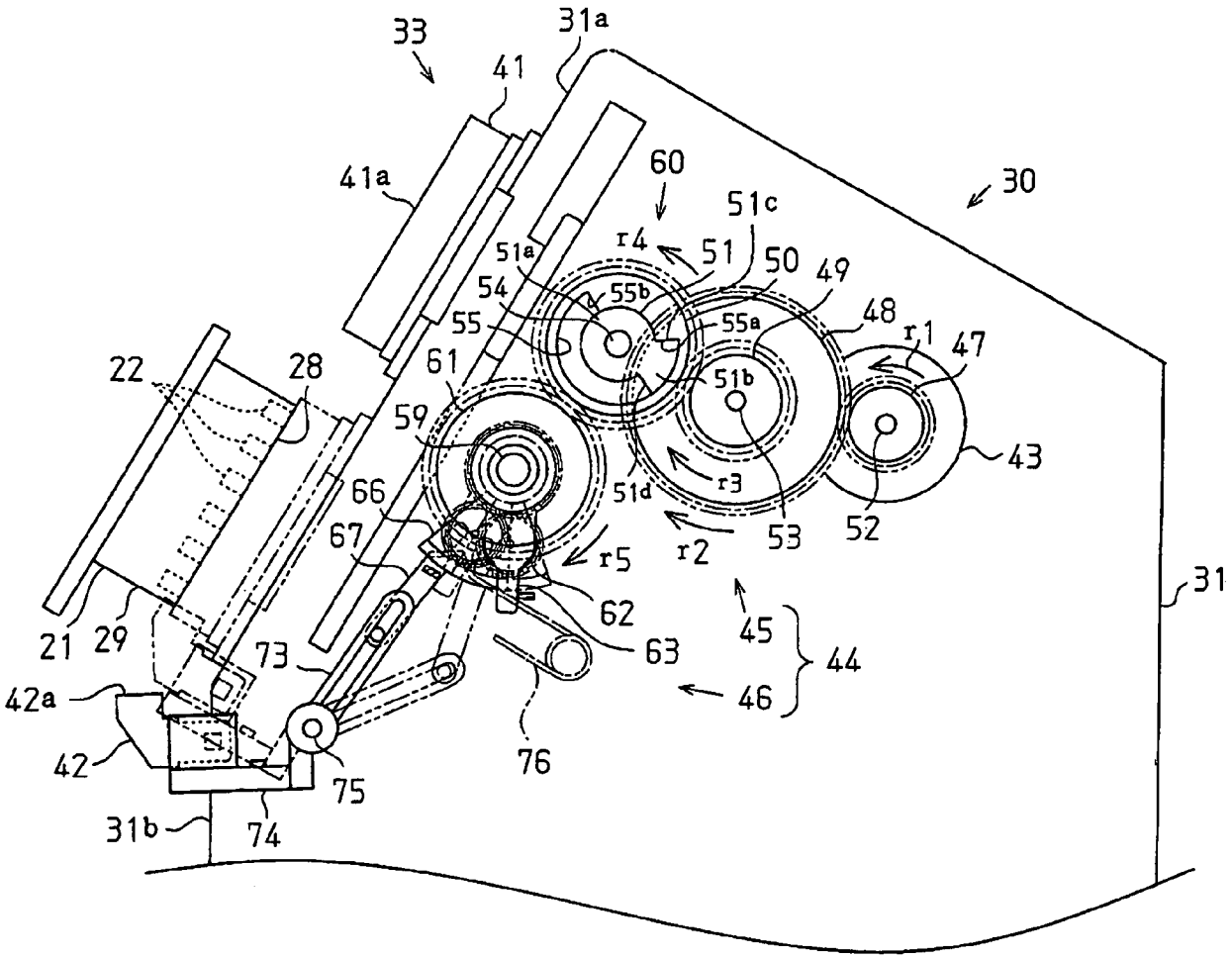
FIG. 2 is a side view schematically showing a maintenance unit of the printer of FIG. 1, particularly a wiper device.

Referring to FIG. 1, a recording head 21, or a liquid ejection head, is formed on a bottom surface of the carriage 16. As shown in FIG. 2, a plurality of ejection nozzles 22 are defined in a bottom surface of the recording head 21. Non-illustrated piezoelectric elements are also arranged in the recording head 21 in correspondence with the nozzles 22. Through excitement of the piezoelectric elements, ink, or liquid, is ejected from each of the nozzles 22 onto the paper sheet P that has reached the position below the recording head 21.

Ink cartridges 23, 24 are separably held in the carriage 16 and thus supply the ink to the recording head 21. An ink chamber (not shown) is defined in each of the ink cartridges 23, 24 and the ink is received and retained in the ink chamber.

As shown in FIG. 1, a waste tank 27 is formed below the platen 12 in the frame 11, extending parallel with the platen 12. The waste tank 27 accommodates an absorptive body (not shown) formed of, for example, porous pulp material. Thus, when cleaning, flushing, or wiping is performed in a known manner, the ink is drained into the waste tank 27 and absorbed by the absorptive body. A maintenance unit 30 is arranged in an end portion (a right end portion as viewed in FIG. 1) of the printer 10, which is a non-ejection area in which the paper sheet P does not proceed.

The maintenance unit 30 has a capping function, a cleaning function, and a wiping function. More specifically, when the printer 10 is in a standby state, the maintenance unit 30 seals a nozzle surface 28 formed in the recording head 21, which is the capping function. The maintenance unit 30 then draws the ink from the nozzles 22 for preventing the nozzles 22 from being clogged, which is the cleaning function. The maintenance unit 30 also wipes the nozzle surface 28 or a lower side surface 29 of the recording head 21, thus adjusting meniscus of the ink in the nozzles 22 and removing excessive ink from the recording head 21, which is the wiping function.

FIG. 2 is a side view schematically showing a wiper device 33 of the maintenance unit 30, particularly. As shown in FIG. 2, the maintenance unit 30 has a casing 31. A cleaning device 32 (see FIG. 1) and the wiper device 33 are arranged in the casing 31. The cleaning device 32 draws the excessive ink from the nozzles 22 and thus prevents clogging of the nozzles 22. The cleaning device 32 includes a cap 34, which seals the recording head 21, and a suction pump (not shown) serving as suction means (a suction mechanism). As shown in FIG. 1, the cap 34 is substantially shaped like a box having an upper opening and inclined at an angle equal to the inclination angle of the nozzle surface 28 of the recording head 21. This allows the cap 34 to face the nozzle surface 28, which is also inclined with respect to a horizontal axis. Known lift means (a known lift mechanism) is provided for selectively raising and lowering the cap 34. When raised, the cap 34 contacts the recording head 21 and seals the nozzles 22 (the nozzle surface 28) of the recording head 21.

The suction pump is then actuated with the nozzles 22 (the nozzle surface 28) of the recording head 21 held in a state sealed by the cap 34. This generates negative pressure in the space defined by the nozzle surface 28 and the cap 34, thus drawing ink with increased viscosity and bubbles from the nozzles 22 into the cap 34. The ink is then discharged into the waste tank 27 through operation of the suction pump and absorbed by the absorptive body in the waste tank 27.

Next, the wiper device 33 will be explained. The wiper device 33 has a nozzle surface wiper 41, or a first wiper, and a side surface wiper 42, or a second wiper. The nozzle surface wiper 41 wipes the nozzle surface 28 of the recording head 21 and the side surface wiper 42 wipes the lower side surface 29 of the recording head 21. The wiper device 33 also includes a drive mechanism that has a drive motor 43, or a drive source, and a transmission mechanism 44. The drive motor 43 is rotatable in forward or reverse directions. The transmission mechanism 44 transmits the drive force generated by the drive motor 43 to the wipers 41, 42.

Each of the nozzle surface wiper 41 and the side surface wiper 42 is formed of flexible material such as elastomer. An upper end of the nozzle surface wiper 41 is formed as a hook-like wiping portion 41*a* curved rightward in direction x of FIG. 1. The nozzle surface wiper 41 projects from an upper surface 31*a* of the casing 31 toward the recording head 21 (diagonally upward as viewed in FIG. 2). Through operation of the transmission mechanism 44, the nozzle surface wiper 41 is allowed to slide between a standby position, which is indicated by the corresponding solid lines of FIG. 2, and a wiping position, which is indicated by the corresponding broken lines of FIG. 2. The standby position of the nozzle surface wiper 41 is located offset rearward from a scanning path of the recording head 21 (extending in direction x). When located at the wiping position, the nozzle surface wiper 41 faces the recording head 21 that has been retracted to a non-printing area and is located substantially flush with the recording head 21. The side surface wiper 42 is arranged on a front surface 31*b* of the casing 31. A wiping portion 42*a* is formed by an end surface of the side surface wiper 42 that faces upward when the side surface wiper 42 is located at a standby position, which is indicated by the corresponding solid lines of FIG. 2. Through the operation of the transmission mechanism 44, the side surface wiper 42 is allowed to pivot in a range of approximately 30 degrees between the standby position and a wiping position, which is indicated by the corresponding broken lines of FIG. 2.

The transmission mechanism 44 has a first gear mechanism 45 and a second gear mechanism 46. The first gear mechanism 45 transmits the drive force of the drive motor 43 to the nozzle surface wiper 41. The second gear mechanism 46 transmits the drive force of the drive motor 43 to the side surface wiper 42 through the first gear mechanism 45. The first gear mechanism 45 includes a first gear 47, a second gear 48, a third gear 49, a fourth gear 50, and a driven member 51, or a delay driven body. The first gear 47 is connected to the rotary shaft (a shaft 52) of the drive motor 43. Thus, when the drive motor 43 rotates in the forward direction, the first gear 47 rotates about the shaft 52 in a counterclockwise direction (direction r1) of FIG. 2. When the drive motor 43 rotates in the reverse direction, the first gear 47 rotates about the shaft 52 in a clockwise direction. The second gear 48 has a diameter greater than the diameter of the first gear 47 and is engaged with the first gear 47. The third gear 49 has a diameter smaller than the diameter of the second gear 48 and is rotatably supported by a common shaft 53, which also supports the second gear 48. The third gear 49 and the second gear 48 are thus rotated in synchronization. The fourth gear 50 is engaged with the third gear 49. Thus, when the first gear 47 is rotated by the drive motor 43, the second gear 48, the third gear 49, and the fourth gear 50 follow the rotation of the first gear 47 and thus rotate in synchronization.

The fourth gear 50 includes a substantially arcuate cam portion 55. The central angle of the cam portion 55 is approximately 240 degrees. The driven member 51 includes a circular portion 51*a* and an arcuate extension 51*b* extending radially outward from a portion of the outer circumference of the circular portion 51*a*. The driven member 51 is engaged with the cam portion 55 of the fourth gear 50. In this state, the driven member 51 and the fourth gear 50 are rotatably supported by a common shaft 54. In a standby state of FIG. 2, a first end 51*c*, or a circumferential end of the extension 51*b*, is held in contact with a first engagement portion 55*a*, or a circumferential end of the cam portion 55. A second end 51*d*, or an opposing circumferential end of the extension 51*b*, is spaced from a second engagement portion 55*b*, or an opposing circumferential end of the cam portion 55, in a rotational direction by a distance corresponding to 180 degrees.

Thus, for example, if the drive motor 43 rotates in the forward direction and thus the fourth gear 50 rotates in the counterclockwise direction (direction r4), the driven member 51 is maintained in a stopped state until the fourth gear 50 rotates a half turn about the shaft 54 (180 degrees). After the half turn of the fourth gear 50, the second engagement portion 55*b* of the cam portion 55 contacts the second end 51*d* of the extension 51*b* of the driven member 51. At this stage, the driven member 51 starts to rotate integrally with the fourth gear 50 in the counterclockwise direction (direction r4). In other words, the rotation of the driven member 51 is delayed with respect to the rotation of the fourth gear 50 by a phase difference of 180 degrees. The nozzle surface wiper 41 is connected to the driven member 51 through a known rack-and-pinion mechanism (not shown). Thus, through the rotation of the driven member 51, the nozzle surface wiper 41 is switched between the standby position and the wiping position, which are indicated by the corresponding solid lines and the corresponding broken lines of FIG. 2, respectively. In the illustrated embodiment, the fourth gear 50 and the driven member 51 define a time-lag mechanism (a power transmission delay mechanism) 60.

As shown in each of FIGS. 3 to 6, the second gear mechanism 46 includes a sun gear portion 56 having a sun gear 61, an intermittent gear portion 57 having an intermittent gear 66, and a link portion 58. The sun gear portion 56 and the intermittent gear portion 57 are supported by a common shaft 59 in such a manner that the sun gear portion 56 and the intermittent gear portion 57 are allowed to rotate freely and independently from each other. The sun gear portion 56 has the sun gear 61, a planet gear 62, and a planet lever 63. The sun gear 61 is meshed with the fourth gear 50 of the first gear mechanism 45. The planet gear 62 is meshed with the sun gear 61. The sun gear 61 and the planet gear 62 thus define a known sun-and-planet gear mechanism. The planet lever 63 is formed integrally with the sun gear 61. Thus, when the sun gear 61 rotates in synchronization with the fourth gear 50 of the first gear mechanism 45, the planet gear 62 and the planer lever 63 rotate in the rotational direction of the sun gear 61 while maintaining the constant relative positions with respect to the sun gear 61.

A first restricting portion 64 and a second restricting portion 65 are arranged in the casing 31. The first and second restricting portions 64, 65 each restrict the rotation amount of the sun gear portion 56. In the standby state of FIG. 2, the planet lever 63 is held in contact with the first restricting portion 64. In the illustrated embodiment, the restricting portions 64, 65 restrict the rotation angle of the sun gear portion 56 up to approximately 40 degrees.

The intermittent gear portion 57 includes the intermittent gear 66 and a lever 67. The intermittent gear 66 has a circular portion 66*a* and an arcuate extension 66*b* extending radially outward from a portion of the outer circumference of the circular portion 66*a*. Teeth 68 are projected from the extension 66*b* toward the planet gear 62 and arranged at a pitch equal to the pitch of the teeth of the planet gear 62. When the teeth 68 contact the planet gear 62 as opposed to each other, the teeth 68 are meshed with the tooth of the planet gear 62. The lever 67 is projected radially outward from the outer circumference of the intermittent gear 66. Thus, when the planet gear 62 rotates in synchronization with the sun gear 61 and the teeth of the planet gear 62 are meshed with the teeth 68 of the intermittent gear 66, the intermittent gear 66 and the lever 67 are rotated (pivoted) about the shaft 59 in a predetermined direction through rotation of the planet gear 62. A substantially rectangular projection 69 is projected from a side surface of the intermittent gear 66. Also, a circular projection 71 is projected from the distal end of the lever 67.

The link portion 58 has a lever joint portion 73 and a side surface wiper joint portion 74. An elongated bore 72 is defined in the lever joint portion 73. The side surface wiper 42 is connected to the side surface wiper joint portion 74. The link portion 58 is rotatably supported by a shaft 75. The projection 71 is engaged with the elongated bore 72 of the lever joint portion 73 in such a manner that the projection 71 slides in the elongated bore 72. Thus, when the lever 67 is rotated (pivoted), the projection 71 of the lever 67 slides in the elongated bore 72 and thus the link portion 58 is rotated about the shaft 75 in a predetermined direction.

The side surface wiper 42 is connected to the distal end of the side surface wiper joint portion 74. Through rotation of the link portion 58 about the shaft 75, the side surface wiper 42 is pivoted between the standby position and the wiping position of FIG. 2. The shafts 52, 53, 54, 59, 75 are fixed to the casing 31 and rotatably support the corresponding gears (the shaft 75 supports the link portion 58). Further, in order to restrict undesired rotation of the intermittent gear 66, a spring 76 having an engagement portion 77 is fixed to the casing 31. The engagement portion 77 has an angular shape and is engaged with the projection 69 of the intermittent gear 66 at a predetermined timing.

The operation of the maintenance unit 30 of the printer 10 will hereafter be explained. The explanation focuses mainly on wiping operation of the maintenance unit 30. In the standby state before the wiping operation, the nozzle surface wiper 41 and the side surface wiper 42 are arranged at the respective standby positions, which are indicated by the corresponding solid lines of FIGS. 2 and 3. For starting the wiping operation, the printer 10 actuates the carriage motor 19 to move the carriage 16 in direction x of FIG. 1. The carriage 16 is thus sent to a maintenance position at which the carriage 16 faces the cap 34 of the maintenance unit 30.

In this state, the nozzle surface wiper 41 and the side surface wiper 42 are moved from the standby positions to the wiping positions. Specifically, the drive motor 43 is rotated in the forward direction and thus the first gear 47 is rotated in the counterclockwise direction (direction r1). This causes the second and third gears 48, 49 to rotate in the clockwise directions (directions r2, r3). The fourth gear 50, which is engaged with the third gear 49, then starts to rotate in the counterclockwise direction (direction r4). This causes the sun gear 61, which is meshed with the fourth gear 50, to rotate in the clockwise direction (direction r5).

Figure 3:
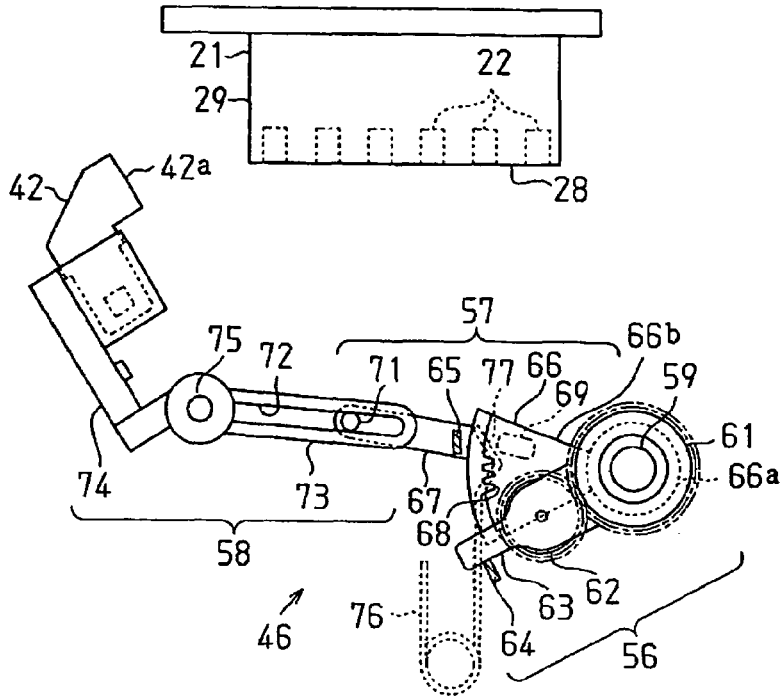
FIG. 3 is a view for explaining operation of a second gear mechanism of the printer of FIG. 1, in which a side surface wiper is arranged at a standby position.
Figure 4:
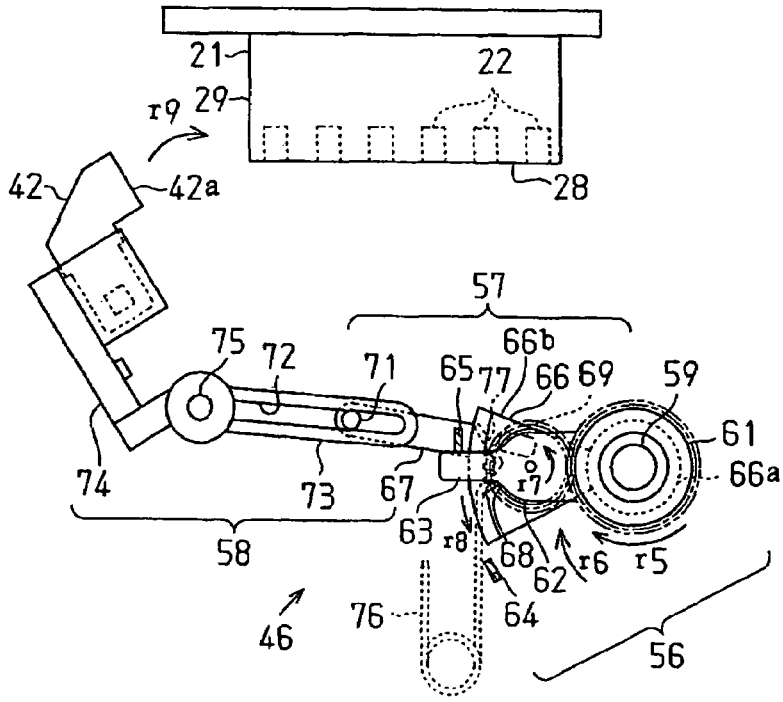
FIG. 4 is a view for explaining the operation of the second gear mechanism of the printer of FIG. 1, in which the side surface wiper is held in a transitional state from the standby position to a wiping position.
Figure 5:
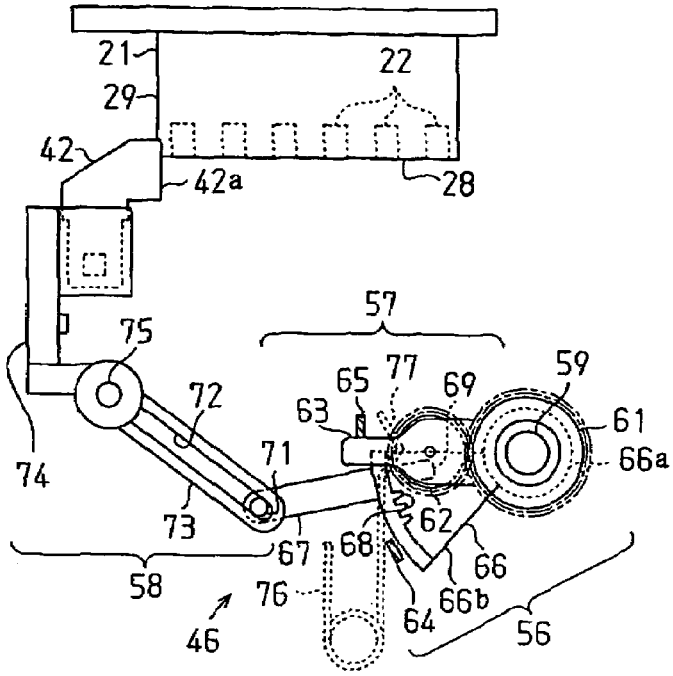
FIG. 5 is a view for explaining the operation of the second gear mechanism of the printer of FIG. 1, in which the side surface wiper is arranged at the wiping position.
Figure 6:
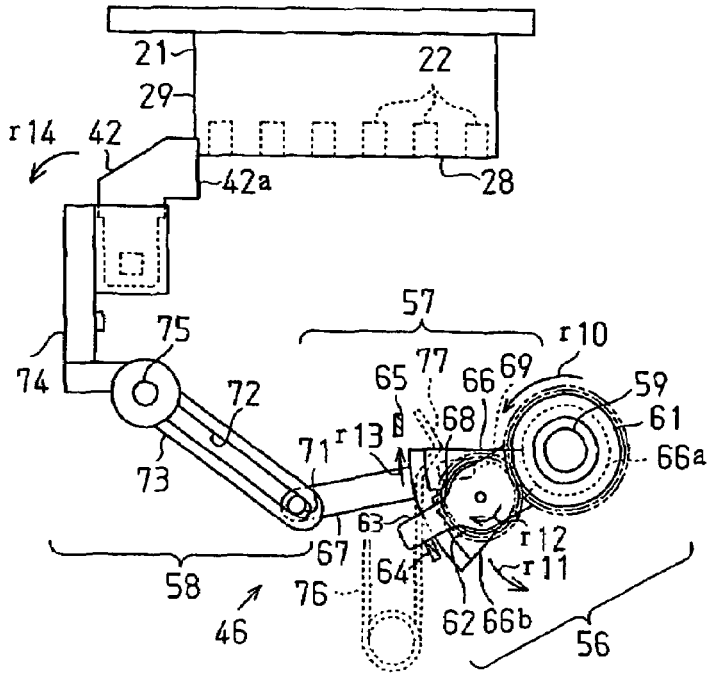
FIG. 6 is a view for explaining the operation of the second gear mechanism of the printer of FIG. 1, in which the side surface wiper is held in a transitional state from the wiping position to the standby position.

FIGS. 3 to 6 are views for explaining the operation of the second gear mechanism 46. In FIG. 3, the side surface wiper 42 is located at the standby position. In FIG. 5, the side surface wiper 42 is located at the wiping position. In FIG. 4, the side surface wiper 42 is held in a transitional state from the standby position to the wiping position. In FIG. 6, the side surface wiper 42 is held in a transitional state from the wiping position to the standby position.

With the side surface wiper 42 arranged at the standby position of FIG. 3, rotation of the drive motor 43 is transmitted sequentially in the manner that has been described, in such a manner that the sun gear 61 starts to rotate in the clockwise direction (direction r5). At this stage, as illustrated in FIG. 4, the planet gear 62 and the planet lever 63 are rotated in the clockwise direction (direction r6) while maintaining the constant relative positions with respect to the sun gear 61. More specifically, in this state, the planet gear 62 revolves around the sun gear 61 while rotating in the counterclockwise direction (direction r7). The planet lever 63 then contacts the second restricting portion 65, thus restricting the rotation of the planet gear 62 and the planet lever 63 in the clockwise direction (direction r6). This stops the planet gear 62 and the planet lever 63. In this state, the planet gear 62 continuously rotates in the counterclockwise direction (direction r7).

Subsequently, with the planet lever 63 held in contact with the second restricting portion 65, the planet gear 62 becomes engaged with the intermittent gear 66. In this state, the planet gear 62 is continuously rotating in the counterclockwise direction (direction r7). The planet gear 62 thus rotates (pivots) the intermittent gear 66 (the lever 67) about the shaft 59 in the counterclockwise direction (direction r8). More specifically, the intermittent gear 66 is urged by the planet gear 62 in the counterclockwise direction (direction r8). This causes the projection 69, which projects from the side surface of the intermittent gear 66, to move beyond the engagement portion 77 of the spring 76 from below, as viewed in FIG. 4. The intermittent gear 66 thus rotates in the counterclockwise direction (direction r8).

While the intermittent gear 66 (the lever 67) rotates in the counterclockwise direction (direction r8), the link portion 58, which is connected to the distal end of the lever 67, rotates about the shaft 75 in direction r9. This moves the side surface wiper 42, which is connected to the distal end of the link portion 58, to the wiping position of FIG. 5. After the side surface wiper 42 has been switched to the wiping position, the drive motor 43 is stopped and thus the intermittent gear 66 is released from the urging force of the planet gear 62, which acts in the counterclockwise direction (direction r8). However, in this state, the projection 69 of the intermittent gear 66 is continuously engaged with the engagement portion 77 of the spring 76 from below. This prevents the intermittent gear 66 from rotating in the direction to return the side surface wiper 42 to the standby position in an undesired manner. In other words, the projection 69 and the spring 76 (the engagement portion 77) define a lock mechanism for maintaining the side surface wiper 42 at the wiping position. The operation that has been described so far is accomplished before the fourth gear 50 completes the half turn.

Even when the fourth gear 50 rotates in the counterclockwise direction (direction r4), the driven member 51 engaged with the cam portion 55 of the fourth gear 50 is maintained in a stopped state until the second engagement portion 55*b* of the cam portion 55 contacts the second end 51*d* of the driven member 51 (until the fourth gear 50 rotates a half turn). However, after the half turn of the fourth gear 50, or once the second engagement portion 55*b* of the cam portion 55 contacts the second end 51*d* of the driven member 51, the second engagement portion 55*b* urges the second end 51*d* to rotate. The driven member 51 thus rotates integrally With the fourth gear 50 in the counterclockwise direction (direction r4). This causes the nozzle surface wiper 41, which is connected to the driven member 51 through the rack-and-pinion mechanism, to slide along the upper surface 31*a* of the casing 31 in a diagonally downward direction as viewed in FIG. 2 (in a forward direction). The nozzle surface wiper 41 is thus switched to the wiping position indicated by the corresponding broken lines of FIG. 2. That is, the driven member 51 starts to rotate after a delay with respect to the rotation of the other gears, which corresponds to a phase difference of 180 degrees with respect to the fourth gear 50. The nozzle surface wiper 41 thus reaches the wiping position after the side surface wiper 42. After the nozzle surface wiper 41 and the side surface wiper 42 are each arranged at the wiping positions, the drive motor 43 is stopped.

The printer 10 then moves the carriage 16, which is currently located at the maintenance position opposed to the cap 34 of the maintenance unit 30, in a direction opposite to direction x of FIG. 1. In this state, the nozzle surface 28 of the recording head 21 is held in contact with the wiping portion 41*a* of the nozzle surface wiper 41, which is arranged at the wiping position. Further, the side surface 29 of the recording head 21 is held in contact with the wiping portion 42*a* of the side surface wiper 42. Thus, by moving the carriage 16 in the direction opposite to direction x, the side surface 29 of the-recording head 21 is caused to slide along the wiping portion 42*a* of the side surface wiper 42 and the nozzle surface 28 to slide along the nozzle surface wiper 41. This permits the nozzle surface wiper 41 to wipe off the ink from the nozzle surface 28 of the recording head 21 and the side surface wiper 42 to wipe off the ink from the side surface 29 of the recording head 21, including the ink that has escaped from the nozzle surface 28 and thus adhered to the side surface 29.

After scanning of the carriage 16 is completed, the nozzle surface wiper 41 and the side surface wiper 42 are returned from the respective wiping positions to the original standby positions. The above-described operation for switching the nozzle surface wiper 41 and the side surface wiper 42 from the standby positions to the wiping positions is thus repeated in a reverse manner.

First, the drive motor 43 is rotated in the reverse direction, thus rotating the first gear 47 in the clockwise direction (a direction opposite to direction r1). The second and third gears 48, 49 are thus rotated in the counterclockwise directions (a direction opposite to direction r2 and a direction opposite to direction r3). This rotates the fourth gear 50, which is engaged with the third gear 49, in the clockwise direction (a direction opposite to direction r4) and the sun gear 61, which is engaged with the fourth gear 50, in the counterclockwise direction (a direction opposite to direction r5).

That is, with the wipers 41, 42 arranged at the wiping positions of FIG. 5, the rotation of the drive motor 43 is sequentially transmitted in the manner that has been described, in such a manner that the sun gear 61 starts to rotate in the counterclockwise direction (direction r10). At this stage, as illustrated in FIG. 6, the planet gear 62 and the planet lever 63 are rotated in the counterclockwise direction (direction r11) while maintaining the constant relative positions with respect to the sun gear 61. More specifically, in this state, the planet gear 62 revolves around the sun gear 61 while rotating in the clockwise direction (direction r12). The planet lever 63 then contacts the first restricting portion 64, thus restricting the rotation of the planet gear 62 and the planet lever 63 in the counterclockwise rotation (direction r11). This stops the planet gear 62 and the planet lever 63. In this state, the planet gear 62 continuously rotates in the clockwise direction (direction r12).

Subsequently, with the planet lever 63 held in contact with the first restricting portion 64, the planet gear 62 becomes engaged with the intermittent gear 66. In this state, the planet gear 62 is continuously rotating in the clockwise direction (direction r12). The planet gear 62 thus rotates (pivots) the intermittent gear 66 (the lever 67) about the shaft 59 in the clockwise direction (direction r13). More specifically, the intermittent gear 66 is urged by the planet gear 62 in the clockwise direction (direction r13). This allows the projection 69, which projects from the side surface of the intermittent gear 66, to move beyond the engagement portion 77 of the spring 76 from below, as viewed in FIG. 6. The intermittent gear 66 thus rotates in the clockwise direction (direction r13).

While the intermittent gear 66 (the lever 67) rotates in the clockwise direction (direction r13), the link portion 58, which is connected to the distal end of the lever 67, rotates about the shaft 75 in direction r14. This returns the side surface wiper 42, which is connected to the distal end of the link portion 58, to the standby position of FIG. 3. The operation that has been described so far is accomplished before the fourth gear 50 completes the half turn in the clockwise direction (the direction opposite to direction r4).

Even when the fourth gear 50 rotates in the clockwise direction (the direction opposite to direction r4), the driven member 51 engaged with the cam portion 55 of the fourth gear 50 is maintained in a stopped state until the first engagement portion 55*a* of the cam portion 55 contacts the first end 51*c* of the driven member 51 (until the fourth gear 50 rotates a half turn). However, after the half turn of the fourth gear 50, or once the first engagement portion 55*a* of the cam portion 55 contacts the first end 51*c* of the driven member 51, the first engagement portion 55*a* urges the first end 51*c* to rotate. The driven member 51 thus rotates integrally with the fourth gear 50 in the clockwise direction (the direction opposite to direction r4). This slides the nozzle surface wiper 41, which is connected to the driven member 51 through the rack-and-pinion mechanism, along the upper surface 31*a* of the casing 31 in a diagonally upward direction as viewed in FIG. 2. The nozzle surface wiper 41 is thus switched to the standby position, which is indicated by the corresponding solid lines of FIG. 2.

That is, as in the switching from the standby positions to the wiping positions, the nozzle surface wiper 41 reaches the standby position after the side surface wiper 42 reaches the standby position. After the nozzle surface wiper 41 and the side surface wiper 42 are each returned to the standby positions, the drive motor 43 is stopped. In this manner, the wiping operation is accomplished.

The wiping operation by the nozzle surface wiper 41 and the side surface wiper 42 is achieved in the above-described manner. However, the printer 10 of the illustrated embodiment may be applied to a case in which only the side surface wiper 42 is operated for wiping the side surface 29 of the recording head 21. In this case, the drive motor 43 is stopped after the side surface wiper 42 is deployed at the wiping position and before the nozzle surface wiper 41 is switched to the wiping position (before the second engagement portion 55*b* of the cam portion 55 is brought into contact with the second end 51*d* of the driven member 51). This holds only the side surface wiper 42 at the wiping position. In this state, the carriage 16 located at the maintenance position in the non-printing area is moved in the direction opposite to direction x of FIG. 1. This wipes the side surface 29 of the recording head 21 without involving the nozzle surface 28 of the recording head 21.

Afterwards, the drive motor 43 is rotated in the reverse direction in such a manner as to return the side surface wiper 42 from the wiping position to the standby position, as has been described. The nozzle surface wiper 41 is maintained at the standby position indicated by the corresponding solid lines of FIG. 2, while the side surface wiper 42 is reciprocated between the standby position and the wiping position. Such independent wiping of the side surface 29 is performed when formation of ink deposit reaches a predetermined level (for example, after an hour after the cleaning operation).

The illustrated embodiment has the following advantages.

(1) In the illustrated embodiment, the transmission mechanism 44, which transmits the drive force of the drive motor 43, includes the time-lag mechanism 60. The time-lag mechanism 60 delays movement of the nozzle surface wiper 41 with respect to movement of the side surface wiper 42. This moves the side surface wiper 42 to the wiping position, independently from the nozzle surface wiper 41. The side surface 29 of the recording head 21 thus can be wiped separately from the nozzle surface 28, regardless of the timing at which wiping of the nozzle surface 28 is performed (for example, when the cleaning operation is carried out). Moreover, if the nozzle surface 28 is not contaminated with excessive ink, the nozzle surface 28 is prevented from being wiped (wiped dry). The meniscus in the nozzle openings is thus maintained, and a printing problem can be avoided.

(2) The side surface wiper 42 is provided separately from the cap 34, which seals the recording head 21. Wiping of the side surface 29 of the recording head 21 thus can be performed, even when capping operation is not being carried out. Also, unlike a case in which the capping operation always involves wiping of the side surface 29, unnecessary increase of the frequency for wiping the side surface 29 is suppressed. This improves durability of the side surface wiper 42 and that of the recording head 21.

(3) In the illustrated embodiment, the nozzle surface wiper 41 and the side surface wiper 42 are driven by the single and common drive source, which is the drive motor 43. This reduces the quantity of the components of the printer 10, thus simplifying the configuration of the printer 10 and reducing the size of the printer 10.

(4) In the illustrated embodiment, the nozzle surface 28 of the recording head 21 is inclined with respect to the horizontal axis. The side surface wiper 42 wipes the lower side surface 29 of the recording head 21, which is a surface located lowermost among the surfaces of the recording head 21. The ink adhered to the nozzle surface 28 after having been ejected from the nozzles 22 or splashed by the paper sheet P easily moves along the nozzle surface 28, which is inclined, and thus forms a deposit on the lower side surface 29, which is located below the nozzle surface 28. In the illustrated embodiment, the ink is removed from the lower side surface 29 by efficiently wiping the lower side surface 29 by the side surface wiper 42.

The illustrated embodiment may be modified as follows.

Regarding the wiper device 33 of the illustrated embodiment, the nozzle surface 28 of the recording head 21 wiped by the wiper device 33 is inclined with respect to the horizontal axis. However, the nozzle surface 28 of the recording head 21 wiped by the wiper device 33 may be oriented horizontally without inclining.

Although the nozzle surface wiper 41 and the side surface wiper 42 of the illustrated embodiment are driven by the common drive source (the drive motor 43), the nozzle surface wiper 41 and the side surface wiper 42 may be actuated by separate drive sources.

In the illustrated embodiment, the time-lag mechanism 60 is defined as the power transmission delay mechanism having a delayed driven body (the delayed driven member 51). The driven member 51 transmits the drive force of the drive motor 43 to the nozzle surface wiper 41 after a delay. However, the time-lag mechanism 60 is not restricted to such configuration. That is, an eventual time lag may be ensured between operation of the nozzle surface wiper 41 and operation of the side surface wiper 42 without performing the delayed power transmission. In this case, for example, gears to which the nozzle surface wiper 41 is connected (nozzle-surface-wiper gears) are provided in a greater size or by a greater quantity than gears to which the side surface wiper 42 is connected (side-surface-wiper gears). This prolongs the time needed for starting movement of the nozzle surface wiper 41 through rotation of the nozzle-surface-wiper gears, compared to the time needed for starting movement of the side surface wiper 42 through rotation of the side-surface-wiper gears. The nozzle surface wiper 41 thus starts to operate after a delay with respect to the side surface wiper 42.

In the illustrated embodiment, the side surface wiper 42 reaches the wiping position before the nozzle surface wiper 41 reaches the wiping position. Similarly, the side surface wiper 42 returns to the standby position before the nozzle surface wiper 41 returns to the standby position. However, the present invention is not restricted to this. For example, the side surface wiper 42 and the nozzle surface wiper 41 may be moved to the respective wiping positions at the same time. Afterwards, only the nozzle surface wiper 41 is returned to the standby position. Alternatively, the nozzle surface wiper 41 and the side surface wiper 42 may be returned to the respective standby positions at the same time, while the movement of the wipers 41, 42 to the respective wiping positions is performed in the same manner as the illustrated embodiment. That is, as long as the side surface wiper 42 can be moved to the wiping position independently from the nozzle surface wiper 41, the movement of the wipers 41, 42 may be performed in any suitable modified manner.

In the illustrated embodiment, the present invention is applied to the printer 10, or the on-carriage type inkjet printer in which the ink cartridges 23, 24 are installed in the carriage 16. However, the present invention is applicable also to an off-carriage type inkjet printer.

In the above illustrated embodiment, the present invention is applied to the printer 10, which ejects ink. However, the present invention may be applied to other types of liquid ejection apparatuses. For example, the present invention may be applied to printing machines including fax machines and copy machines, a liquid injecting apparatus for injecting liquid such as electrode material or color material used for manufacturing liquid crystal displays, electro luminescent displays and surface light emitting displays. The present invention may also be applied to liquid injecting apparatus for injecting biological organic matter used for manufacturing biochips. Alternatively, the present invention may be applied to sample injecting apparatus such as a precision pipette. Also, the present invention may be applied to devices that use liquid other than ink.

What is claimed is:

1. A wiper device comprising:

a first wiper that wipes a nozzle surface defined in a liquid ejection head;

a second wiper that wipes a side surface of the liquid ejection head extending in a direction intersecting the nozzle surface, the second wiper being formed separately from a cap that seals the nozzle surface of the liquid ejection head; and a drive mechanism that drives the first and second wipers to move between respective standby positions and wiping positions, the drive mechanism operating to move the second wiper to the corresponding wiping position independently from the first wiper, wherein the drive mechanism includes one or more drive sources and a transmission mechanism that transmits drive force generated by the one or more drive sources to the first and second wipers, the transmission mechanism including a time-lag mechanism that delays movement of the first wiper with respect to movement of the second wiper when the first and second wipers are moved from the respective standby positions to the respective wiping positions by the drive force.

2. The device according to claim 1, wherein the time-lag mechanism is a power transmission delay mechanism that delays transmission of the drive force to the first wiper with respect to transmission of the drive force to the second wiper.

3. The device according to claim 2, wherein the power transmission delay mechanism includes a drive body and a delayed driven body, the drive body being rotated by the drive force of the one or more drive sources, the delayed driven body being rotated after a delay with respect to start of rotation of the drive body, the drive force being transmitted from the one or more drive sources to the first wiper through rotation of the delayed driven body.

4. The device according to claim 1, wherein the drive mechanism includes the single drive source.

5. The device according to claim 1, wherein the nozzle surface of the liquid ejection head is inclined with respect to a horizontal axis, and wherein the side surface of the liquid ejection head is one of a plurality of side surfaces intersecting the nozzle surface, and the second wiper wipes one of the side surfaces that is located lowermost among the side surfaces.

6. A liquid ejection apparatus comprising:

a liquid ejection head that has a nozzle surface and a side surface extending in a direction intersecting the nozzle surface;

a cap that seals the nozzle surface of the liquid ejection head; and a wiper device including:

a first wiper that wipes the nozzle surface of the liquid ejection head;

a second wiper that wipes the side surface of the liquid ejection head, the second wiper being formed separately from the cap; and a drive mechanism that drives the first and second wipers to move between respective standby positions and wiping positions, the drive mechanism operating to move the second wiper to the corresponding wiping position independently from the first wiper, wherein the drive mechanism includes one or more drive sources and a transmission mechanism that transmits drive force generated by the one or more drive sources to the first and second wipers, the transmission mechanism including a time-lag mechanism that delays movement of the first wiper with respect to movement of the second wiper when the first and second wipers are moved from the respective standby positions to the respective wiping positions by the drive force.

* * * * *